United States Patent [19]

Saito et al.

[11] Patent Number: 5,058,539

[45] Date of Patent: Oct. 22, 1991

[54] VALVE TIMING ADJUSTING SYSTEM FOR INTERNAL COMBUSTION ENGINE

[75] Inventors: Masaharu Saito; Seiji Tsuruta; Katsuhiko Uchida; Seiji Suga, all of Kanagawa, Japan

[73] Assignee: Atsugi Unisia Corporation, Kanagawa, Japan

[21] Appl. No.: 585,735

[22] Filed: Sep. 20, 1990

[30] Foreign Application Priority Data

Sep. 20, 1989 [JP] Japan ..... 1-109815[U]
Feb. 28, 1990 [JP] Japan ..... 2-19539[U]
Feb. 28, 1990 [JP] Japan ..... 2-19540[U]

[51] Int. Cl.[5] ..... F01L 1/34

[52] U.S. Cl. ..... 123/90.17; 123/90.31; 464/2

[58] Field of Search ..... 123/90.15, 90.17, 90.31; 464/2

[56] References Cited

U.S. PATENT DOCUMENTS 4,811,698 3/1989 Akasaka et al. ..... 123/90.17
4,862,843 9/1989 Kawamoto et al. ..... 123/90.17
4,889,086 12/1989 Scapecchi et al. ..... 123/90.31
5,012,773 5/1991 Akasaka et al. ..... 123/90.17

*Primary Examiner*—E. Rollins Cross
*Assistant Examiner*—Weilun Lo
*Attorney, Agent, or Firm*—Bachman & Lapointe

[57] ABSTRACT

A valve timing adjusting system includes mutually parallel axial fluid paths both formed about a fastening bolt which engages with an axial bore formed at the end of a camshaft. One of the axial paths if formed through the fastening bolt and the other axial path is formed between the outer periphery of the fastening bolt and the inner periphery of the axial bore of the camshaft. This avoids necessity of formation of axial fluid path through the camshaft and thus redudes mashing step in production line to lead lower cost.

13 Claims, 6 Drawing Sheets

VALVE TIMING ADJUSTING SYSTEM FOR INTERNAL COMBUSTION ENGINE

BACKGROUND OF THE INVENTION

1. Field of the Invention

The present invention relates generally to a valve timing adjusting system for an internal combustion engine for adjusting phase relationship between a crankshaft and a camshaft which operates an intake valve and an exhaust valve. More specifically, the invention relates to a valve timing adjusting system which has improved hydraulic circuit construction for simplified fluid path construction and for easy manufacture.

2. Description of the Background Art

Japanese Patent First (unexamined) Publication (Tokkai) Showa 63-131808 discloses a valve timing adjusting system for an internal combustion engine. The shown system includes a timing pulley driven by an engine output torque and thus rotates in synchronism with a crankshaft, and a camshaft which is co-axially arranged with the timing pulley. A cylindrical gear member is disposed between the timing pulley and the camshaft for transmitting rotational torque with an adjusted phase relationship. For this, the cylindrical gear member is formed with an external gear teeth and an internal gear teeth respectively meshing with the internal gear teeth of the timing pulley and the external gear teeth of the camshaft, at least one of the external and internal gear teeth of the cylindrical member is formed as a helical gear teeth so that phase relationship between the timing pulley and the camshaft in rotation can be adjusted depending upon the axial position of the cylindrical gear member.

Pressure chambers are defined at both axial ends of the cylindrical gear member. The pressure chambers are connected to fluid pressure source via fluid path circuit with a two-way electromagnetic valve which control introduction and draining of pressurized fluid into and from the pressure chambers and whereby adjusts the axial position of the cylindrical gear member. In the shown construction, the fluid path circuits for respective of the pressure chambers are mutually independent to each other in order to accomplish high response of axial position adjustment of the cylindrical member and wide range of phase relationship adjustment.

On the other hand, in order to realize the independent pressure supply for respective pressure chamber with independent fluid path circuits, it becomes necessary to define two mutually independent fluid path opening through the camshaft. One of the fluid path openings have radial section and axial section, which radial section extends radially through the camshaft and for communicating with the axial bore defined in the camshaft, and which axial section extends through a fastening bolt. The other fluid circuit has an axial section extending in axial direction in parallel relationship with the axial section formed through the fastening bolt. The axial section of the other fluid circuit is thus formed through the camshaft. Such construction of the fluid circuit necessarily lower the stiffness and strength of the camshaft per se and requires substantially care in machining or production. It necessarily cause rising of the production cost. Furthermore, for facilitating of independent control of respectively fluid circuit, two electromagnetic two-way valves becomes necessary and accordingly required two independent fluid circuit piping between a fluid circuit main gallery and the electromagnetic valves. This additionally causes high production cost.

SUMMARY OF THE INVENTION

Therefore, it is an object of the present invention to provide a valve timing control system for an internal combustion engine with an improved fluid circuit construction for simplified construction and lower production cost.

In order to accomplish aforementioned and other objects, a mutually parallel axial fluid path are both formed about a fastening bolt which engages with an axial bored formed at the end of a camshaft. One of the axial paths is formed through the fastening bolt and the other axial path is formed between the outer periphery of the fastening bolt and the inner periphery of the axial bore of the camshaft. This avoids necessity of formation of axial fluid path through the camshaft and thus reduces mashining step in production line to lead lower cost.

according to one aspect of the invention, a valve timing adjusting system comprises:

an engine revolution synchronous rotary element driven by an output of an internal combustion engine;

a camshaft assembly including a driven member secured to a camshaft by means of a fastening bolt engaged with an axial bore formed in the camshaft;

an intermediate member disposed between the rotary element and the camshaft for transmitting rotating torque from the rotary element to the driven member with a given phase relationship between the rotary element and the driven member, the intermediate member being thrustingly movable for adjusting the phase relationship;

a first and second pressure chambers formed at both sides of the intermediate member for positioning the intermediate member at a position where pressure balance is established.

a first fluid path defined through the fastening bolt for fluid communication between the first pressure chamber and a pressure source;

a second fluid path defined between the fastening bolt and the inner periphery of the axial bore for establishing fluid communication between the second pressure chamber and the pressure source; and a flow control valve responsive to a control signal commanding desired phase relationship between the rotary element and the driven member establishing and blocking the first and second fluid paths.

The flow control valve means may dispose between a common supply line supplying pressurized fluid, a common drain line draining the pressureized fluid, and the first and fluid second paths so that when one of the first and second fluid paths is communicated to the supply line, the other is communicated with the drain line. Preferably, the flow control valve means comprises a common valve. In the alternative, the first pressure chamber selectively communicated with a first supply line supplying pressurized fluid and a first drain line draining pressurized fluid across a first flow control valve means, and the second pressure chamber is selectively communicated with a second supply line and a second drain line acrosss a second flow control valve means, and the first and second flow control valve means are operated in alternative fashion so that when one of the first and second pressure chambers is communicated to associated on e of the first and second supply lines, the other is communicated with associated one of the first and the second drain lines. In such case, it is possible that first flow control valve means comprises a flow restriction orifice disposed between the first supply line and the first fluid path and an ON/OFF valve selectively establishing and blocking fluid communication between the first pressure chamber and the first drain line.

According to another aspect of the invention, a valve timing adjusting system for an automotive internal combustion engine for adjusting open and close timing of intake and exhaust valves depending upon engine driving condition, the system comprises:

a rotary input element associated with a crankshaft for synchronous rotation with the crankshaft, the input element having a first gear teeth;

a camshaft assembly including a driven element secured to a camshaft by means of a fastening bolt engaged with an axial bore formed in the camshaft for rotation therewith, the driven element being formed with a secon gear teeth, the second gear teeth being oriented in spaced apart relationship with the first gear teeth defining therebetween a given clearance;

an intermediate ring gear element disposed within the clearance defined between the input element and the driven element, the ring gear element having a third gear meshing with the first gear teeth and a fourth gear meshing with the second gear teeth, the ring gear element being axially movable relative to the input element and the driven element and incorporating means for converting magnitude of axial shifting of the ring gear element into phase shift between the input element and the driven element for establishing desired phase relationship between the crankshaft and the camshaft;

a first and second pressure chambers defined at both sides of the ring gear element for positioning the latter at a position where the force balance therebetween is established;

a first fluid path having a first section extending externally, a second section extending along the axis of the fastening bolt and a third section communicated with the first pressure chamber;

a second fluid path having a fourth section extending externally, a fifth section defined between the fastening bolt and the inner periphery of the axial bore and extending in parallel relationship with the second section of the first fluid path, and a sixth section communicated with the second pressure chamber; and a flow control valve means responsive to an engine driving condition dependent control signal command desired phase relationship between the crankshaft and the camshaft for selectively establishing and blocking the first and second fluid paths for adjusting axial position of the ring gear at a position where the desired phase relationship is established.

In such case, the axial bore formed through the camshaft having a first larger diameter section oriented in the vincinity of axial end thereof and a second smaller diameter section oriented remote from the axial end and having threaded inner periphery for engaging with the front end portioin of the fasteneing bolt which has an intermediate plain shaft section to be oriented within the first larger diameter section, and a threaded axial end engaging with the threaded inner periphery of the smaller diameter section, the intermediate plain shaft section having smaller diameter than the internal diameter of the larger diameter section of the axial bore for defining therebetween the second section of the second fluid path. Preferably, the fastening bolt has a length shorter than the axial length of the axial bore for defining a first communication chamber therebetween, the first section and second section of the first fluid path being communicated across the first communication chamber. A second communication chamber may be defined at the axial end of the fastening bolt remote remote from the first communication chamber, and the second and third sections of the first fluid path are communicated across the second communication chamber.

BRIED DESCRIPTION OF THE DRAWINGS

The present invention will be discussed herebelow from the detailed description given herebelow and from the accompanying drawings of the preferred embodiment of the present invention, which, however, should not be taken to limit the invention to the specific embodiments but are for explanation and understanding only.

DESCRIPTION OF THE PREFERRED EMBODIMENT

Figure 1:
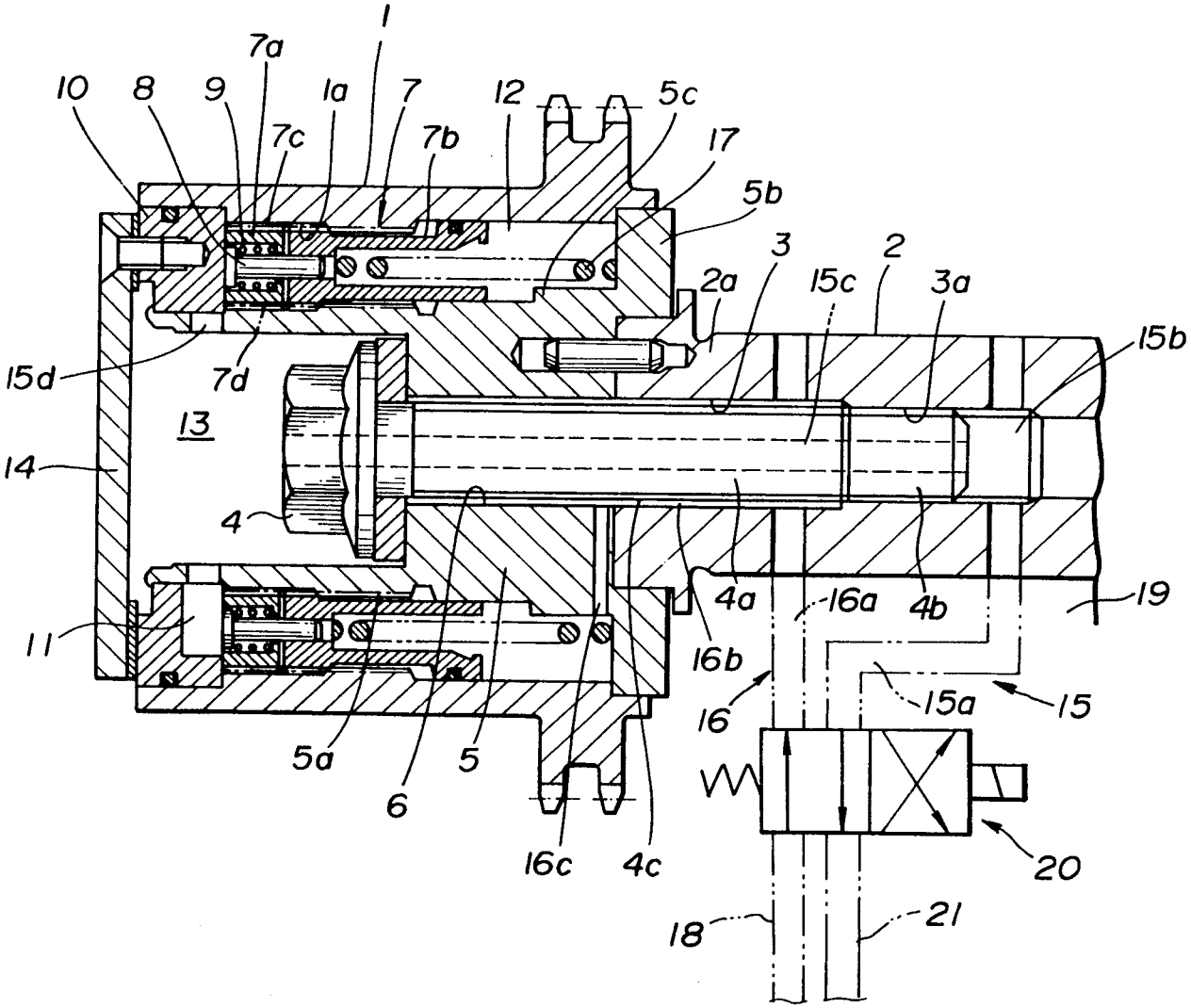
FIG. 1 is a section of the first embodiment of a valve timing adjusting system according to the present invention.

Referring now to the drawings, particularly to FIG. 1, there is illustrated the first embodimeent of a valve timing adjusting system, according to the present invention, which is applicable for adjusting valve open and close timing of an intake and exhause valves of a double overhead camshaft type automotive internal combustion engine. The system includes a sprocket 1 which has a timing gear 1A drivingly associated with a crankshaft of the engine via a timing chain, and a cylindrical extension 1B which is formed with an internal gear teeth 1*a* on the inner periphery thereof. The sprocket 1 is driven synchronously with the engine revolution by the driving torque transmitted through the crankshaft and the timing chain, for rotatingly driving a camshaft 2 which carries a plurality of timing cam driving intake and exhaust valves with a given phase relationship with the crankshaft.

As can be appreciated, the shown embodiment employs chain drive system for driving the camshaft, the present invention is not limited to apply for the engine having chain drive system for driving the camshaft but can be applied for the engine having belt drive system for driving the camshaft by the rotational torque transmitted through a timing belt. In such case, the sprocket may be replaced with a timing pulley.

The camshaft 2 has an end portion 2*a* having an axially extending threaded bore 3. A sleeve 5 is rigidly secured on the axial end of the camshaft by means of a fastening bolt 4 which engages the threaded bore 3 of the camshaft 2. As can be seen from FIG. 1, the thread 3*a* is formed in the limited portion, i.e. only in the portion oriented in the vicinity of the bottom of the bore. Remaining portion oriented in the vicinity of the axial end of the camshaft is thus provided plain inner pereipheral surface. The sleeve 5 is formed with an axial bore 6 to receive therethrough the fastening bolt 4. On the other hand, the sleeve 5 is formed with an external gear teeth 5*a*. The fastening bolt 4 is provided smaller diameter at a shaft section 4*a* than the internal diameter of the axial bore 6. A threaded end section 4*b* is formed at the end of the fastening bolt 4, so that the threaded end section may engage with the internal thread 3*a* on the inner periphery of the threaded bore 3.

An intermediate gear assembly 7 is disposed between the sprocket 1 and the sleeve 5. The intermediate gear assembly 7 is formed in generally cylindrical configuration and separated into two mutually independent sections 7*a* and 7*b* which are arranged in alignment to each other. Respective of the sections 7*a* and 7*b* are formed with identical external and internal gear teeth 7*c* and 7*d*. These sections 7*a* and 7*b* are connected by a plurality of connecting pins 8. The connecting pin 8 is biased by means of a coil spring 9 for biasing the section 7*b* toward the section 7*a*. The external teeth 7*c* of the intermediate gear assembly 7 meshes with the internal gear teeth 1*a* of the sprocket 1. On the other hand, internal gear teeth 7*d* of the intermediate gear assembly 7 meshes with the internal gear teeth 5*a* of the sleeve 5.

The annular space defined between the sprocket 1 and the sleeve 5 for receiving therein the intermediate gear assembly 7, has an open end at the end remote from the camshaft 2. The open end of the annular space is closed by a closure ring 10. The closure ring 10 restricts movement of the axial movement of the intermediate gear assembly 7. On the other hand, the axial movement of the intermediate gear assembly 7 away from the closure ring 10 is restricted by stepped edge 5*c* of the sleeve 5. The closure ring 10 defines a first pressure chamber 11 opposing to the axial end of the section 7*a* of the intermediate gear assembly 7. A second pressure chamber 12 is defined between the radially extending flange 5*b* and section 7*b* of the intermediate gear assembly 7. A coil spring 17 which is provided substantially small spring force is disposed within the second pressure chamber 12. The coil spring 17 normally biases the intermediate gear assembly 7 toward the closure ring 10. Therefore, the coil spring 17 serves for initially setting the intermediate gear assembly 7 at the outwardly shifted position urged toward the closure ring 10 while the engine is not running.

A fluid chamber 13 is defined by the cylidrica extension of the sleeve 5. The front open end of the fluid chamber 13 is closed by a cover plate 14 which is sealingly fixed onto the closure ring 10 by means of fastening bolts.

The first and second pressure chambers 11 and 12 are connected to a fluid pressure source which supplies working fluid, e.g. lubricant, via first and second fluid circuit systems 15 and 16. The first fluid circuit system 15 is formed through the cylinder head 19 and extends radially through the camshaft 2. The first fluid circuit system 15 includes a first section 15*a* extending substantially parallel to the axis of the camshaft 2, a second section 15*b* adjoining with the first section 15*a* and extending across the camshaft and a third section 15*c* axially extending through the fastening bolt 4 and adjoining to the other end of the second section. The third section 15*c* is communicated with the first pressure chambe 11 via radial paths 15*d*. On the other hand, the first fluid circuit 15 is connected to an oil main galley 18 a the upstream end thereof.

On the other hand, the second fluid circuit system 16 is also formed through the cylinder head 19 and extends across the camshaft 2. The upstearm end of the second fluid circuit system 16 is connected to a oil main gallery 18. The second fluid circuit system 16 includes a first section 16*a* extending perpendicular to the axis of the camshaft and a second section 16*b* defined between the outer periphery of the fastening bolt 4 and the inner periphery of the axial bore 6, and a third section 16*c* extending radially through the sleeve 7.

A four-way flow control valve 20 is provided at the intersection between the upstream ends of the first and second fluid circuit systems 15 and 16 and the oil main galleries 18 and 21. The flow control valve 20 comprises an electromagnetic valve which is switchable for selectively establishing fluid communication. Namely, the when the first fluid circuit system 15 is communicated with the oil main gallery 18, the fluid communication between the second fluid circuit system 16 and the oil main gallery 18 is blocked. At the same time, fluid communication between hte second fluid circuit system 16 and a drain line 21 is established.

The flow control valve 20 is defined connected to a control unit to receive therefrom a control signal derived on the basis of pre-selected engine control parameters, such a crankshaft angular position, an intake air flow rate and so forth.

In the shown embodiment, under low end load range, LOW level control signal is supplied to the flow control value 20 from the control unit. In response to this, the flow control valve establishes the first fluid circuit system 15 and the drain line 21 for draining the working fluid from the first pressure chamber 11. Simultaneously, the flow control valve 20 establishes fluid communication between the second fluid circuit system 16 and the oil main gallery 18 for supplying the pressurized fluid into the second pressure chamber 12. Therefore, the fluid pressure in the second pressure chambesr 12 is increased. Accordingly, the intermediate gear assembly 7 is axially shifted by the spring force of the coil spring 17 and the increased fluid pressure in the second pressure chamber 12. By causing axial shifting of the intermediate gear assembly 7, relative phase displacement is caused by helical gear teeth forming at least one of gear set of the internal gear 1*a* of the sprocket and the external gear 7*c* of the intermediate gear assembly 7, and gear set of the internal gear 7*d* and the external gear 5*a* of the sleeve 5. By shifting the intermediate gear assembly 7 toward the closure ring 10, the close timing of the intake valve is retarded. Retarding of the intake valve close timing makes combustioning in the engine stable and thus effective for achieving fuel economy.

On the other hand, at high engine load range, HIGH level control signal is supplied to the flow control valve 20. Then, fluid communication between the second fluid circuit system 16 and the drain line 21 is established for lowering the fluid pressure in the second pressure chamber 12. At the same time, the first fluid circuit system 15 is communicated with the oil main gallery 18 for increasing the fluid pressure in the first pressure chamber 11. Therefore, by the fluid pressure in the first pressure chamber 11, the intermediate gear assembly 7 is shifted to cause advancing of intake valve close timing. This causes increasing of the mixture induction efficiency for higher output power.

Figure 2:
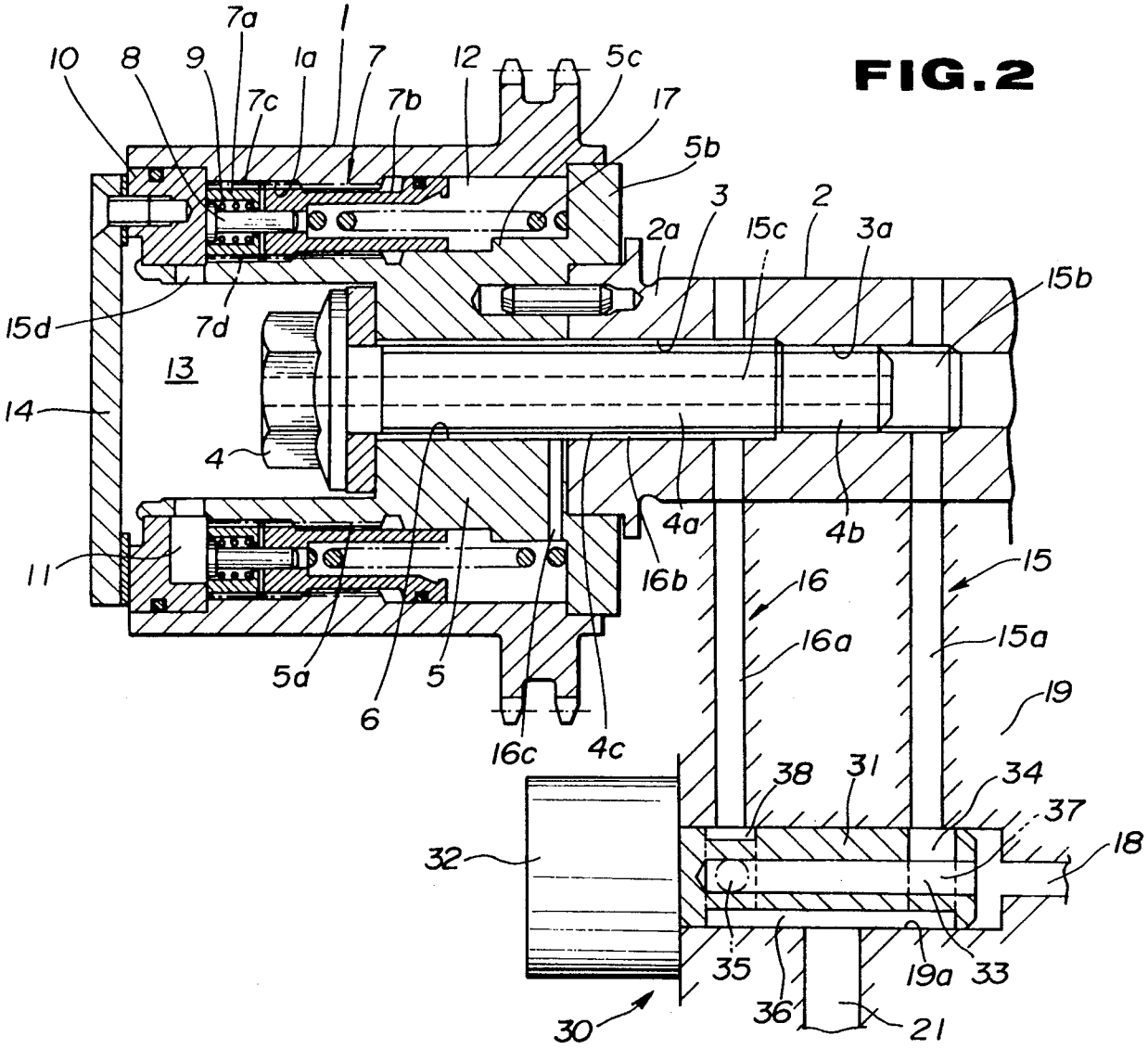
FIG. 2 is a section of the second embodiment of a valves timing adjusting system according to the invention.
Figure 3:
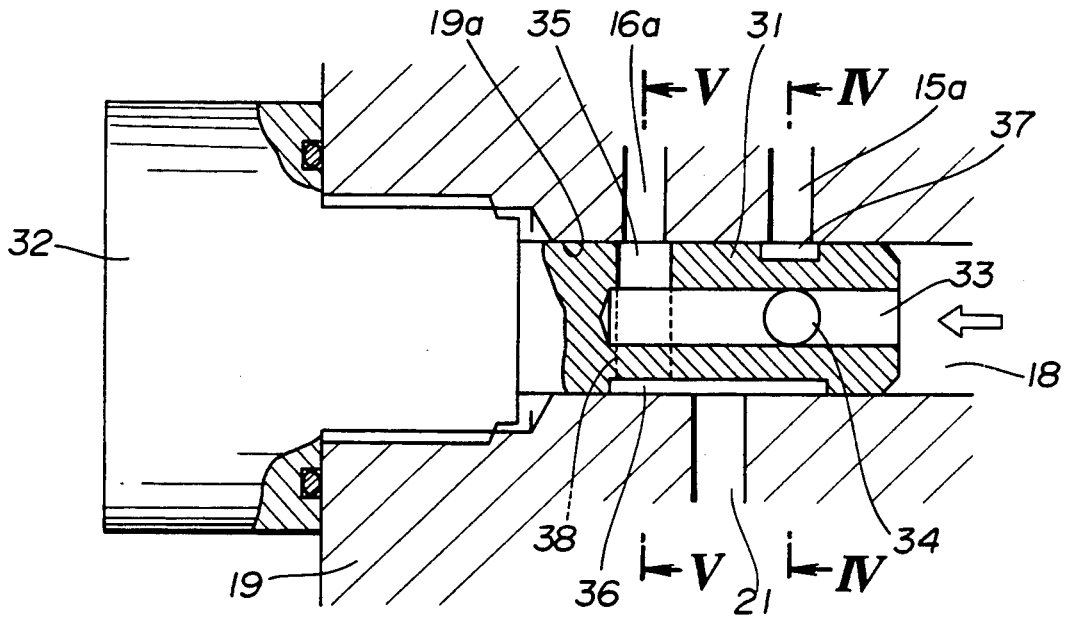
FIG. 3 is an enlarged section of a flow control valve employed in the second embodiment of the valve timing adjusting system of FIG. 2.
Figure 4:
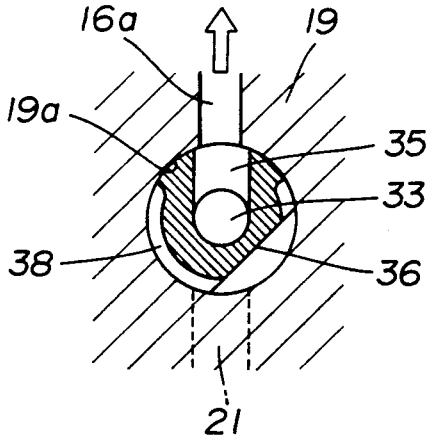
FIGS. 4 and 5 are sections taken along lines IV —IV and V—V of FIG. 3
Figure 5:
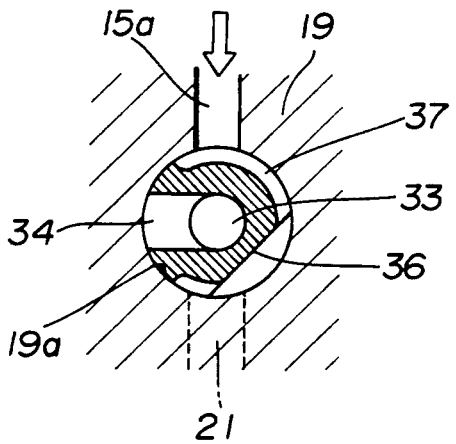

FIG. 2 shows the second embodiment of a valve timing adjusting system, according to the invention. The shown embodiment has essentially the identical construction as that in the foregoing first embodiment except for the construction of the flow control valve 30. IN the shown embodiment, the flow control valve 30 comprises a rotary valve.

Since the most component of the second embodiment of the valve timing adjusting system are identical to the foregoing first embodiment, the common components to the former embodiment will be represented by the same reference numeral to the first embodiment.

In the shown embodiment, a valve bore 19*a* is formed in the cylinder head 19. The oil main gallery 18 is formed in alignment with the valve bore 19*a* for adjoining at one axial end thereof. The first sections 15*a* and 16*a* are formed through the cylinder head in perpendicular to the axis of the axial bore 6. The drain line 21 is connected to the valve bore 19*a* and extends perpendicular to the valve bore.

As shown in FIGS. 3 to 8, a rotary valve body 31 is rotatably disposed within the valve bore 19*a*. The rotary valve body 31 is rotatingly driven by a solenoid 32 which drives the rotary valve body in both direction. The rotary valve body 31 defines an axial path 33 which is aligned with the oil main gallery 18 to introduce the pressurized fluid therethrough. Radial paths 34 and 35 are formed perpendicular to the axis of the valve bore and angularly offset to each other at 90°. A drain path 36 is formed between the rotary valve body 31 and the inner periphery of valve bore 19*a*. The drain path 36 is communicated with a circumferentially extending groove 37 formed on the outer periphery of the rotary valve body 31.

Figure 6:
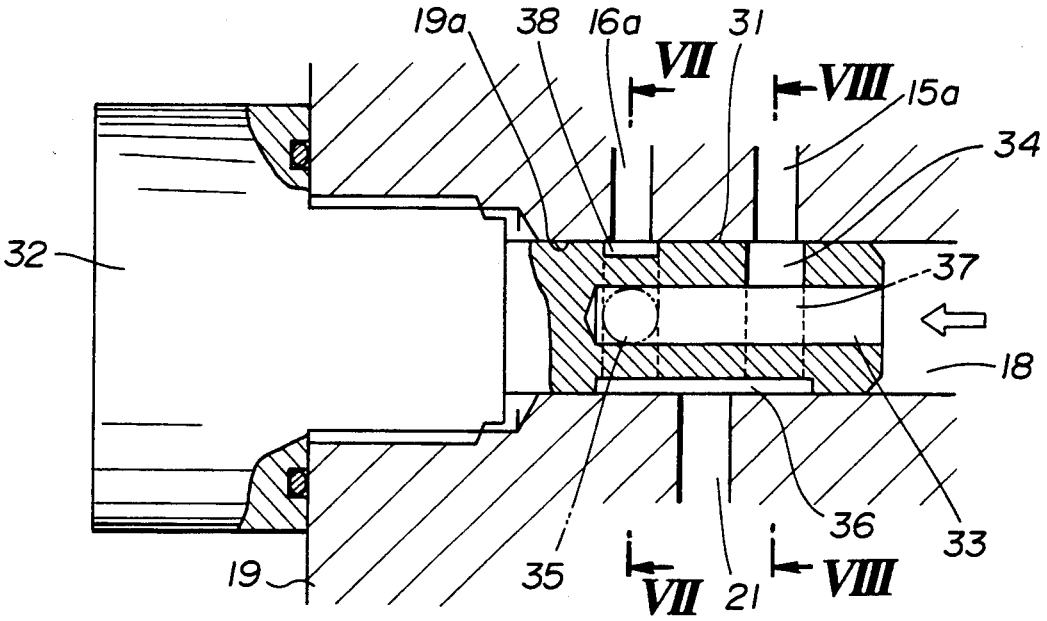
FIGS. 6, 7 and 8 are sections similar to FIGS. 3, 4 and 5 but showing in a position operated to different mode position.
Figure 7:
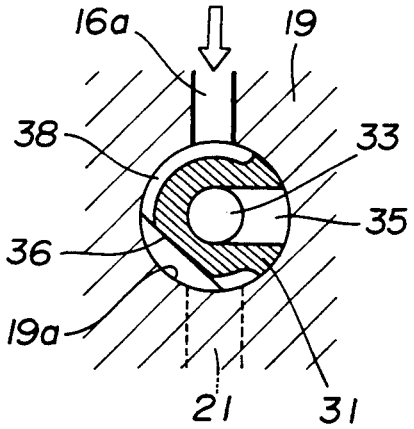
Figure 8:
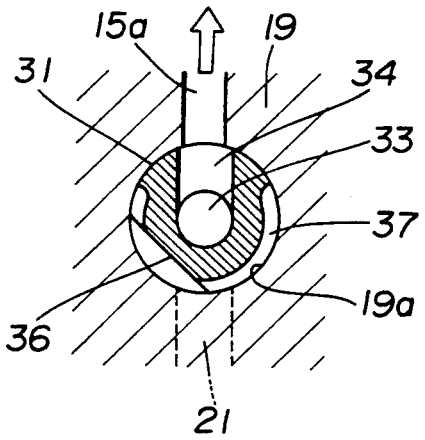

The rotary valve body 31 is rotatingly driven between two way positions illustrated in FIGS. 3 to 8. Namely, when the engine is driven at low load range, the LOW level control signal is supplied to the solenoid 32 to place the rotary valve 31 in a position shown in FIGS. 3 to 5. As can be seen, at this position, the radial path 35 is aligned with the first section 16*a* of the second fluid circuit system 16 so that the oil main gallery 18 is communicated with the second fluid circuit system for supplying the fluid pressure to the second pressure chamber 12. At the same time, the circumferential groove 37 is communicated with the first section 15*a* of the first fluid circuit system 15 for establishing fluid communication between the first fluid circuit system 15 and the drain line 21 via the circumferential groove 37 and the drain path 36. On the other hand, when the engine is driven under high load, the HIGH level control signal is supplied to the solenoid 32 for positioning the rotary valve body 31 at the position as shown in FIGS. 6 to 8. As can be seen, at this position, the radial path 34 is aligned with the first section 15*a* of the first fluid circuit system 15 so that the oil main gallery 18 is communicated with the second fluid circuit system for supplying the fluid pressure to the second pressure chamber 12. At the same time, the circumferential groove 37 is communicated with the first section 16*a* of the second fluid circuit system 16 for establishing fluid communication between the second fluid circuit system 16 and the drain line 21 via the circumferential groove 37 and the drain path 36.

Figure 9:
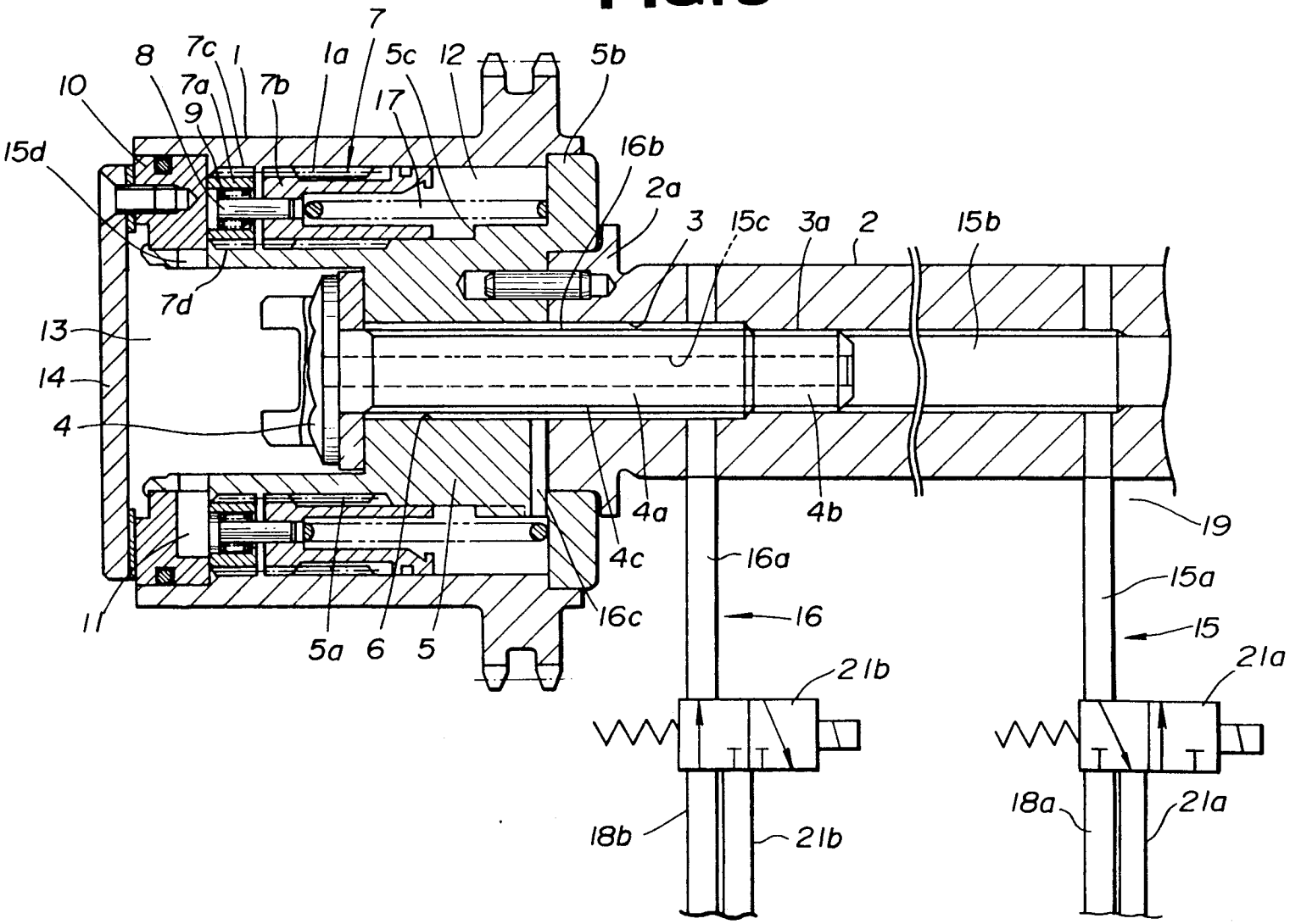
FIG. 9 is a section of the third embodiment of a valve timing adjusting system according to the invention.

FIG. 9 shows the third embodiment of the valve timing adjusting system according to the invention. In this embodiment, separated first and second flow control valves 20*a* and 20*b* are provided in the four way flow control valve 20 employed in the foregoing first embodiment. In the shown embodiment, the first fluid circuit system 15 is associated with the first main oil gallery 18*a* and the first drain line 21*a*. Similarly, the second fluid circuit system 16 is associated with the second main oil gallery 18*b* and the second drain line 21*b*. The first flow control valve 20*a* selectively communicate the first fluid circuit system 15 with one of the first main oil gallery 18*a* and the first drain line 21*a*. The second flow control valve 20*b* selectively communicate the second fluid circuit system 16 with one of the second main oil gallery 18*b* and the second drain line 21*b*. Respective of the first and second flow control valves 20*a* and 20*b* establish four-way fluid control as that peerformed by the flow control valve in the first embodiment.

Figure 10:
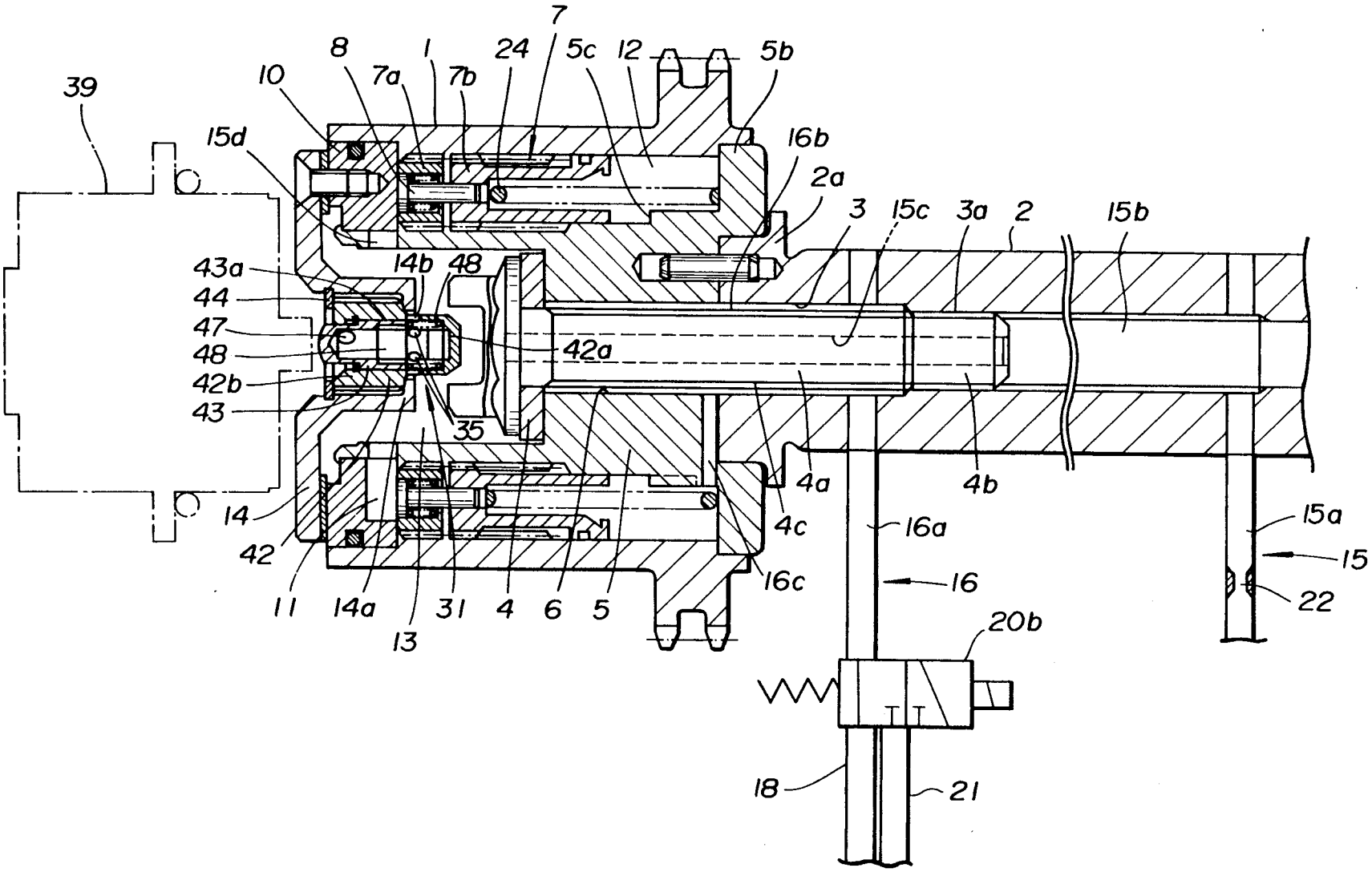
FIG. 10 is a section of the fourth embodiment of the valve timing adjusting system according to the invention.

FIG. 10 shows the fourth embodiment of the valve timing adjusting system according to the invention. In this embodiment, the first flow control valve 20*a* is replaced with a flow restriction orifice 22. In addition, the shown embodiment is provided with an ON/OFF valve assembly 41. The ON/OFF valve assembly 41 is supported by a valve supporting section 14*a* of the cover plate 14. The ON/OFF valve assembly 41 has a valve body 43 thrustingly disposed within a cylindrical valve housing 32. The cylindrical valve housing 32 has a larger diameter section 32*b* and a smaller diameter section 32*a*. The smaller diameter section 32*a* has a closed The larger diameter section 32*b* is secured within the valve supporting section 14*a* by means of a stopper ring 34. A center hold 14*b* is formed in the valve supporting section 14*a*. The smaller diameter section 32*a* of the valve housing 32 extends into the fluid chamber 13. A plurality of radially extending small holes 35 are formed through the smaller diameter 32*a*. A valve body 33 is disposed within the valve housing 32 for selectively opening and closing the small holes 35. The valve body 33 defines an axial bore 36 communicated with a drain hole 37.

The valve body 33 is biased in a direction for opening the small holes 35 by means of a coil spring 38. An actuator 39 is supported on a rocker cover in opposition to the outer end of the valve body 33. The actuator 39 is responsive to a control signal to drive the valve body 33 in a direction for closing the small holes 35 for blocking fluid communication between the fluid chamber 13 and the drain hole 37.

With the combination of the ON/OFF valve assembly 41 and the flow restriction orifice 22, substantially the same effect to the foregoing third embodiment can be achieved.

In the embodiments set forth above, the fluid circuit construction can be successfully simplified. In addition, with the shown construction in adjustment of valve timing in response to engine load variation can be achieved.

While the present invention has been discussed in detail in terms of the preferred embodiments of the invention, the invention can be embodined in various fashion. Therefore, the invention should be understood to include all embodiments and modifications which can be embodied without departing from the principle of the invention.

What is claimed is:

1. A valve timing adjusting system comprising:

an engine revolution synchronous rotary element driven by an output of an internal combustion engine;

a camshaft assembly including a driven member secured to a camshaft by means of a fastening bolt engaged with an axial bore formed in said camshaft;

an intermediate member disposed between the rotary element and said driven member for transmitting rotating torque from said rotary element to said driven member with a given phase relationship between said rotary element and said driven member, said intermediate member being thrustingly movable for adjusting said phase relationship;

first and second pressure chambers formed at one and the other side of said intermediate member, respectively, for positioning said intermediate member at a position where pressure balance is established;

a first fluid path defined through said fastening bolt for fluid communication between said first pressure chamber and a pressure source;

a second fluid path defined between said fastening bolt and the inner periphery of said axial bore for establishing fluid communication between said second pressure chamber and said pressure source; and a flow control valve means responsive to a control signal commanding desired phase relationship between said rotary element and said driven member establishing and blocking said first and second fluid paths.

2. A valve timing adjusting system as set forth in claim 1, wherein said flow control valve means is disposed between a common supply line supplying pressurized fluid, a common drain line draining the pressurized fluid, wherein one of said first and second fluid paths is communicated to said supply line, the other is communicated with said drain line.

3. A valve timing adjusting system as set forth in claim 2, wherein said flow control valve means comprises a common valve.

4. A valve timing adjusting system as set forth in claim 3, wherein said first pressure chamber selectively communicated with a first supply line supplying pressurized fluid and a first drain line draining pressurized fluid across a first flow control valve means, and said second pressure chamber is selectively communicated with a second supply line and a second drain line across a second flow control valve means, and said first and second flow control valve means are operated in alternative fashion so that when one of said first and second pressure chambers is communicated to associated one of said first and second supply lines, the other is communicated with associated one of said first and second drain lines.

5. A valve timing adjusting system as set forth in claim 4, wherein said first flow control valve means comprises a flow restriction orifice disposed between said first supply line and said first fluid path and an ON/OFF valve selectively establishing and blocking fluid communication between said first pressure chamber and said first drain line.

6. A valve timing adjusting system for an automotive internal combustion engine for adjusting open and close timing of intake and exhaust valves depending upon engine driving condition, the system comprising:

a rotary input element associated with a crankshaft for synchronous rotation with said crankshaft, said input element having a first gear teeth;

a camshaft assembly including a driven element secured to camshaft by means of a fastening bolt engaged with an axial bore formed in said camshaft for rotation therewith, said driven element being formed with a second gear teeth, said second gear teeth being oriented in spaced apart relationship with said first gear teeth defining therebetween a given clearance;

an intermediate ring gear element disposed within said clearance defined between said input element and said driven element, said ring gear element having a third gear meshing with said first gear teeth and a fourth gear meshing with said second gear teeth, said ring gear element being axially movable relative to said input element and said driven element and incorporating means for converting magnitude of axial shifting of said ring gear element into phase shift between said input element and said driven element for establishing desired phase relationship between said crankshaft and said camshaft;

first and second pressure chambers defined at one and the other side of said ring gear element, respectively, for positioning the latter at a position where force balance therebetween is established;

a first fluid path having a first section extending externally of said camshaft, a second section extending along the axis of said fastening bolt and a third section communicated with said first pressure chamber;

a second fluid path having a fourth section extending externally of said camshaft; a fifth section defined between said fastening bolt and the inner periphery of said axial bore and extending in parallel relationship with said second section of said first fluid path, and a sixth section communicated with said second pressure chamber; and a flow control valve means responsive to an engine driving condition dependent control signal commanding desired phase relationship between said crankshaft and said camshaft for selectively establishing and blocking said first and second fluid paths for adjusting axial position of said ring gear at a position where said desired phase relationship is established.

7. A valve timing adjusting system as set forth in claim 6, wherein said axial bore formed through said camshaft having a first larger diameter section oriented in the vicinity of axial end thereof and a second smaller diameter section oriented remote from said axial end and having threaded inner periphery for engaging with the front end portion of said fastening bolt which has an intermediate plain shaft section to be oriented within said first larger diameter section, and a threaded axial end engaging with said threaded inner periphery of said smaller diameter section, said intermediate plain shaft section having smaller diameter than the internal diameter of said larger diameter section of said axial bore for defining therebetween said second section of said second fluid path.

8. A valve timing control system as set forth in claim 7, wherein said fastening bolt has a length shorter than the axial length of said axial bore for defining a first communication chamber therebetween, said first section and second section of said first fluid path being communicated across said first communication chamber.

9. A valve timing control system as set forth in claim 8, wherein a second communication chamber is defined at the axial end of said fastening bolt remote from said first communication chamber, and said second and third sections of said first fluid path are communicated across said second communication chamber.

10. A valve timing adjusting system as set forth in claim 9, wherein said flow control valve means is disposed between a common supply line supplying pressurized fluid, a common drain line draining the pressurized fluid, wherein one of said first and second fluid paths is communicated to said supply line, the other is communicated with said drain line.

11. A valve timing adjusting system as set forth in claim 10, wherein said flow control valve means comprises a common valve.

12. A valve timing adjusting system as set forth in claim 11, wherein said first pressure chamber selectively communicated with a first supply line supplying pressurized fluid and a first drain line draining pressurized fluid across a first flow control valve means, and said second pressure chamber is selectively communicated with a second supply line and a second drain line across a second flow control valve means, and said first and second flow control valve means are operated in alternative fashion so that when one of said first and second pressure chambers is communicated to associated one of said first and second supply lines, the other is communicated with associated one of said first and second drain lines.

13. A valve timing adjusting system as set forth in claim 12, wherein said first flow control valve means comprises a flow restriction orifice disposed between said first supply line and said first fluid path and an ON/OFF valve selectively establishing and blocking fluid communication between said second communication chamber and said first drain line.

* * * * *